US011306521B2

(12) United States Patent
Chavez Romero et al.

(10) Patent No.: US 11,306,521 B2
(45) Date of Patent: Apr. 19, 2022

(54) AUTOMATIC ADJUSTABLE LOCK KNOB BEZEL

(71) Applicant: GM Global Technology Operations LLC, Detroit, MI (US)

(72) Inventors: Andres Chavez Romero, Toluca (MX); Jesus Edgar Dominguez Cuevas, Jiutepec (MX); Alejandro Barrera Torres, Metepec (MX)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 744 days.

(21) Appl. No.: 16/209,184

(22) Filed: Dec. 4, 2018

(65) Prior Publication Data

US 2020/0173206 A1 Jun. 4, 2020

(51) Int. Cl.

| | |
|---|---|
| ***E05B 85/08*** | (2014.01) |
| ***E05B 77/38*** | (2014.01) |
| ***E05B 83/36*** | (2014.01) |
| ***E05B 79/20*** | (2014.01) |
| ***E05B 79/22*** | (2014.01) |
| ***E05B 79/06*** | (2014.01) |

(Continued)

(52) U.S. Cl.

CPC ..... *E05B 85/08* (2013.01); *E05B 77/38* (2013.01); *E05B 79/04* (2013.01); *E05B 79/06* (2013.01); *E05B 79/18* (2013.01); *E05B 79/20* (2013.01); *E05B 79/22* (2013.01); *E05B 83/36* (2013.01); *E05B 85/085* (2013.01); *Y10T 292/57* (2015.04); *Y10T 292/82* (2015.04)

(58) Field of Classification Search

CPC ..... E05B 79/06; E05B 79/04; E05B 79/18; E05B 79/20; E05B 85/085; E05B 85/08; E05B 77/38; E05B 83/36; E05B 79/22; E05B 79/02; Y10T 292/82; Y10T 292/1047; Y10T 292/1082; Y10T 292/1092; Y10T 292/57; B60J 5/0455

See application file for complete search history.

(56) References Cited

U.S. PATENT DOCUMENTS 1,947,282 A * 2/1934 Theis ..... H01H 25/06 74/553
1,977,037 A * 10/1934 Birdsall ..... E05B 1/00 292/347

(Continued)

FOREIGN PATENT DOCUMENTS

FR 2132992 A5 * 11/1972 ..... F16B 19/1081

*Primary Examiner* — Christine M Mills
*Assistant Examiner* — Faria F Ahmad
(74) *Attorney, Agent, or Firm* — Vivacqua Crane PLLC

(57) ABSTRACT

A self-adjustable lock knob bezel assembly includes a body of a polymeric material. The body includes an elastically flexible umbrella having a cylindrical bore extending through the umbrella. Multiple dynamic interface members are positioned within the cylindrical bore and extend away from an inner perimeter wall defined by the cylindrical bore toward a longitudinal central axis of the body. Multiple flexible finger sets extend outwardly from the body. Multiple elastically deflecting legs are positioned below the finger sets. A vehicle door panel includes an aperture receiving the body. A lock knob is positioned within the cylindrical bore and directly contacts each of the dynamic interface members in each of a raised un-locked position and a lowered locked position.

16 Claims, 6 Drawing Sheets

(51) Int. Cl.
*E05B 79/18* (2014.01)
*E05B 79/04* (2014.01)

(56) References Cited

U.S. PATENT DOCUMENTS 1,989,420 A * 1/1935 Keeler ..... E05B 1/04 292/347
2,351,803 A * 6/1944 Best ..... G05G 1/085 49/351
2,430,727 A * 11/1947 Morgen ..... E05B 3/00 292/347
2,433,240 A * 12/1947 Schlage ..... E05B 1/00 292/347
2,530,303 A * 11/1950 Keeler ..... E05B 85/10 292/347
2,708,845 A * 5/1955 Trammell, Jr. ..... E05B 85/08 70/181
2,735,289 A * 2/1956 Trammell, Jr. ..... E05B 85/08 70/181
2,834,628 A * 5/1958 Paparelli ..... E05B 85/08 292/347
2,939,307 A * 6/1960 Trammell, Jr. ..... E05B 85/08 70/181
2,950,614 A * 8/1960 Evans ..... E05B 85/08 70/181
3,003,803 A * 10/1961 Kirk ..... E05B 85/08 292/347
3,351,974 A * 11/1967 Wilhelmi ..... E05B 85/08 16/2.1
3,408,836 A * 11/1968 Trammell, Jr. ..... E05B 85/08 70/181
3,455,592 A * 7/1969 Bela ..... E05B 85/08 292/347
3,604,741 A * 9/1971 Steere, Jr. ..... E05B 1/0007 292/347
3,623,758 A * 11/1971 Trinca ..... E05B 85/08 292/347
3,836,269 A * 9/1974 Koscik ..... H02G 3/0658 403/197
3,838,876 A * 10/1974 Haven ..... E05B 85/08 292/1
3,860,278 A * 1/1975 Dalia ..... E05B 85/08 292/347
3,915,485 A * 10/1975 Richman ..... E05B 85/08 292/1
3,999,788 A * 12/1976 Livingston ..... E05B 85/08 292/1
4,134,358 A * 1/1979 Heermans ..... A47J 27/212 116/137 R
4,169,620 A * 10/1979 Pacura ..... E05B 85/08 292/1
4,183,569 A * 1/1980 Landfried ..... E05B 85/08 292/347
4,193,166 A * 3/1980 Neff ..... A47J 45/063 16/441
4,238,133 A * 12/1980 Trammell, Jr. ..... E05B 85/08 292/336.3
4,239,270 A * 12/1980 Bridges ..... E05B 85/08 292/1
4,415,192 A * 11/1983 Kodama ..... E05B 85/08 292/1
4,593,430 A * 6/1986 Spangler ..... B25G 3/18 16/422
4,610,588 A * 9/1986 Van Buren, Jr. ..... F16B 37/043 411/173
4,648,643 A * 3/1987 Bettger ..... E05B 1/0053 292/347
4,674,780 A * 6/1987 Weinerman ..... E05B 85/08 292/1
4,844,463 A * 7/1989 Zembrod ..... A63B 67/14 473/587
5,337,447 A * 8/1994 Tanaka ..... H02G 3/083 16/2.2
5,676,409 A * 10/1997 Trammell, Jr. ..... E05B 77/26 292/336.3
5,794,995 A * 8/1998 Creesy ..... E05B 85/08 292/348
5,873,690 A * 2/1999 Danby ..... F16B 37/043 411/55
5,911,790 A * 6/1999 Bates ..... F16C 1/265 74/502.4
6,056,335 A * 5/2000 Dietrich ..... E05B 85/08 292/347
6,242,064 B1 * 6/2001 Howie, Jr. ..... A44B 1/06 150/155
6,560,819 B2 * 5/2003 Mizuno ..... B60R 16/0222 16/2.1
7,108,302 B2 * 9/2006 Zingelmann ..... E05B 85/08 292/337
7,332,678 B2 * 2/2008 Pyron ..... B60R 16/0222 174/660
7,401,484 B1 * 7/2008 Holmes ..... E05B 13/10 292/336.3
7,488,012 B2 * 2/2009 Eller ..... E05B 63/18 292/164
7,496,993 B2 * 3/2009 Kosidlo ..... F16B 5/0621 24/295
7,874,775 B2 * 1/2011 Hullmann ..... F16B 37/043 411/173
8,794,863 B2 * 8/2014 Hohmann ..... G05G 1/02 403/322.4
9,853,437 B2 * 12/2017 Coyle ..... H02G 3/065
9,903,138 B2 * 2/2018 Bauer ..... E05B 85/08
10,573,436 B2 * 2/2020 Coyle ..... H01B 17/30
10,578,250 B2 * 3/2020 Lamiable ..... F17C 13/04
2005/0073158 A1 * 4/2005 Zingelmann ..... E05B 85/08 292/336.3
2017/0328094 A1 * 11/2017 Zia ..... E05B 79/20
2018/0320407 A1 * 11/2018 Mason ..... E05B 83/18
2019/0106913 A1 * 4/2019 Fukuchi ..... E05B 77/22

* cited by examiner

AUTOMATIC ADJUSTABLE LOCK KNOB BEZEL

The present disclosure relates to lock knobs and lock knob assemblies for automobile vehicle doors.

Door trim panels for automobile vehicles normally require either two or four lock knob bezels depending on the quantity of doors, with each bezel designed specifically for the program or the vehicle make and model. The requirement to provide a specific lock knob bezel for every program or vehicle design is due mainly to styling requirements which differ for each door upper assembly. The requirement for multiple different bezel designs introduces complexity in manufacture, part stocking and installation tracking, and therefore increases vehicle investment costs. Component poke-yoke features are also commonly included to prevent inadvertent installation of a lock knob bezel in an incorrect orientation or vehicle.

Thus, while current automobile vehicle lock knob bezel designs achieve their intended purpose, there is a need for a new and improved automobile lock knob bezel system and method for installation.

SUMMARY

According to several aspects, a self-adjustable lock knob bezel includes a body of a polymeric material. The body includes: an elastically flexible umbrella having a cylindrical bore extending through the umbrella; multiple dynamic interface members positioned within the cylindrical bore and extending away from an inner perimeter wall defined by the cylindrical bore toward a longitudinal central axis of the body; multiple flexible finger sets extending outwardly from the body; and multiple elastically deflecting legs positioned below the finger sets.

In another aspect of the present disclosure, each of the dynamic interface members includes a convex shaped curved surface facing toward the longitudinal central axis of the body.

In another aspect of the present disclosure, a closest point of each of opposed ones of the curved surfaces of the dynamic interface members defines a diameter smaller than a diameter of the cylindrical bore.

In another aspect of the present disclosure, each of the flexible finger sets is radially aligned with one of the dynamic interface members.

In another aspect of the present disclosure, each of the flexible finger sets includes multiple upwardly directed elastically flexible fingers.

In another aspect of the present disclosure, a diameter defined by opposed ones of the flexible finger sets is less than a diameter of the umbrella.

In another aspect of the present disclosure, each of the legs includes an upper leg portion having an outwardly sloping surface extending away from the longitudinal central axis of the body.

In another aspect of the present disclosure, the upper leg portion of each of the legs extends to an outer inflection point from which a lower leg portion downwardly and inwardly extends toward the longitudinal central axis of the body.

In another aspect of the present disclosure, the lower leg portion ends at an end point which is positioned closer to the longitudinal central axis of the body than the inflection point.

In another aspect of the present disclosure, the multiple dynamic interface members include a first dynamic interface member, a second dynamic interface member, a third dynamic interface member and a fourth dynamic interface member, each having a football-shape, and each equidistantly separated from a successive one of the dynamic interface members.

According to several aspects, a self-adjustable lock knob bezel assembly includes a body of a polymeric material. The body includes an elastically flexible umbrella having a cylindrical bore extending through the umbrella. Multiple dynamic interface members are positioned within the cylindrical bore and extend away from an inner perimeter wall defined by the cylindrical bore toward a longitudinal central axis of the body. Multiple flexible finger sets extend outwardly from the body. Multiple elastically deflecting legs are positioned below the finger sets. A vehicle door panel includes an aperture receiving the body. A lock knob is positioned within the cylindrical bore and directly contacts each of the dynamic interface members in each of a raised un-locked position and a lowered locked position.

In another aspect of the present disclosure, each of the flexible finger sets includes multiple upwardly directed elastically flexible fingers each directly contacting an inner wall defined by the aperture to resist release of the body from the aperture.

In another aspect of the present disclosure, the inner wall is downwardly extended by an extending portion positioned below a surface of the vehicle door panel to increase a surface area for contact by each of the flexible fingers.

In another aspect of the present disclosure, an inflection point of each of the legs extending past an end surface of the extending portion in an installed position of the body, with the legs outwardly elastically rebounding such that an outwardly sloping surface of each of the legs contacts the end surface to resist release of the body from the aperture.

In another aspect of the present disclosure, when the umbrella is positioned against a maximum pitched surface of the vehicle door panel defining an angle alpha of up to approximately 25 degrees from a horizontal reference the umbrella sealingly engages for 360 degrees against the vehicle door panel and a first elevation point of the umbrella is positioned at a higher elevation than a second elevation point of the umbrella with the lock knob maintained in a substantially vertical orientation in each of the raised un-locked position and the lowered locked position.

In another aspect of the present disclosure, when the umbrella is positioned against a variable pitched surface of the vehicle door panel that is substantially continuously curved ranging over an angle beta of up to approximately 25 degrees from a horizontal reference, the umbrella sealingly engages for 360 degrees against the vehicle door panel and a first elevation point of the umbrella is positioned at a higher elevation than a second elevation point of the umbrella with the lock knob maintained in a substantially vertical orientation in each of the raised un-locked position and the lowered locked position.

In another aspect of the present disclosure, the aperture includes a chamfer to slidingly receive and elastically deflect the legs of the body.

According to several aspects, a method for aligning a lock knob using a self-adjustable lock knob bezel assembly, comprises: aligning multiple legs of a self-adjustable lock knob bezel with an aperture created in a vehicle door panel and inserting the lock knob bezel into the aperture to elastically inwardly deflect the legs; continuing to insert the lock knob bezel into the aperture until multiple flexible finger sets extending outwardly from the body elastically deflect and directly contact in inner wall defined by the aperture; completing insertion of the lock knob bezel by seating an elastically flexible umbrella of the lock knob bezel against a surface of the vehicle door panel; and positioning a lock knob within a cylindrical bore of the umbrella with the lock knob directly contacting each of multiple dynamic interface members extending into the cylindrical bore from an inner perimeter wall defined by the cylindrical bore.

In another aspect of the present disclosure, the completing insertion of the lock knob bezel step further includes inserting the lock knob bezel until an inflection point of each of the legs extends past an end surface of an extending portion of the aperture thereafter allowing the legs to outwardly deflect to contact the end surface.

In another aspect of the present disclosure, the completing insertion of the lock knob bezel step further includes positioning the umbrella with the umbrella is sealingly engaged for 360 degrees against the surface of the vehicle door panel and a first elevation point of the umbrella is positioned at a higher elevation than a second elevation point of the umbrella with the lock knob maintained in a substantially vertical orientation in each of a raised un-locked position and a lowered locked position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
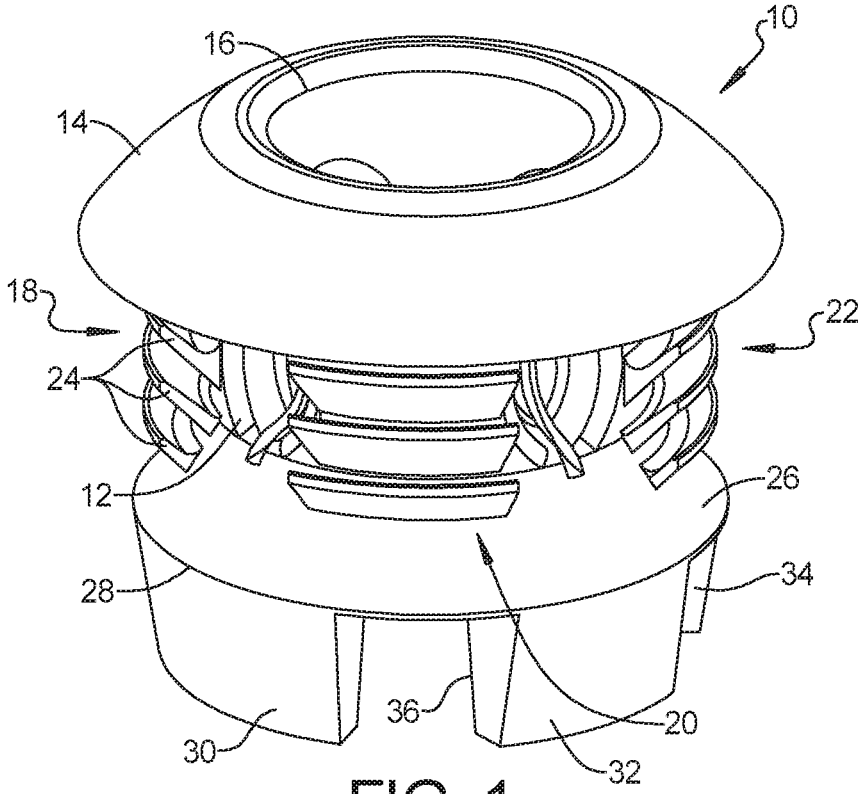
FIG. 1 is a front perspective view of a self-adjustable lock knob bezel assembly according to an exemplary embodiment.

Referring to FIG. 1, a self-adjustable lock knob bezel 10 includes a body 12 of a polymeric material such as but not limited to a thermoplastic elastomer such as thermoplastic vulcanizate (TPV) material, which is molded for example using an injection molding process. Each of the following features of the body 12 are homogeneously and integrally formed with the body 12. The body 12 includes a downwardly directed umbrella 14 having a cylindrical bore 16 extending through the umbrella 14 and the body 12. According to several aspects, the umbrella 14 is substantially circular when viewed from above, however the umbrella 14 can also have an oval or obround shape. The body 12 further includes multiple sets of upwardly angled flexible fingers, including at least a first finger set 18, a second finger set 20 and a third finger set 22. Each of the finger sets includes multiple fingers 24 integrally extending from the body out to a free end. The free ends of each of the fingers 24 can elastically flex toward and away from the body 12. Each of the finger sets is substantially equidistantly spaced from a successive one of the finger sets about a perimeter of the body 12 and is positioned below the umbrella 14 as viewed in FIG. 1.

The body 12 further includes an outwardly directed conical-shaped member 26 positioned below the finger sets from which a guide assembly 28 integrally extends. The guide assembly 28 defines multiple legs, including at least a first leg 30, a second leg 32 and a third leg 34. Each of the legs is substantially equidistantly spaced from a successive one of the legs about a perimeter of the body 12. A gap 36 is commonly provided between any two successive ones of the legs, which allows the legs to elastically deflect inwardly from the as-molded position shown, and to return to the as-molded position during installation of the self-adjustable lock knob bezel 10 which is described in greater detail in reference to FIG. 6.

Referring to FIG. 2 and again to FIG. 1, positioned equidistantly from each other and extending inwardly from an inner perimeter wall 37 defined by the cylindrical bore 16 are at least three "football-shaped" dynamic interface members. In the exemplary embodiment provided by FIG. 2, the dynamic interface members include a first dynamic interface member 38, a second dynamic interface member 40, a third dynamic interface member 42 and a fourth dynamic interface member 44, each substantially equidistantly spaced from a successive one of the dynamic interface members about the inner perimeter wall 37 of the body 12. Each of the dynamic interface members are also equidistantly spaced from a longitudinal central axis 46 of the body 12.

Figure 2:
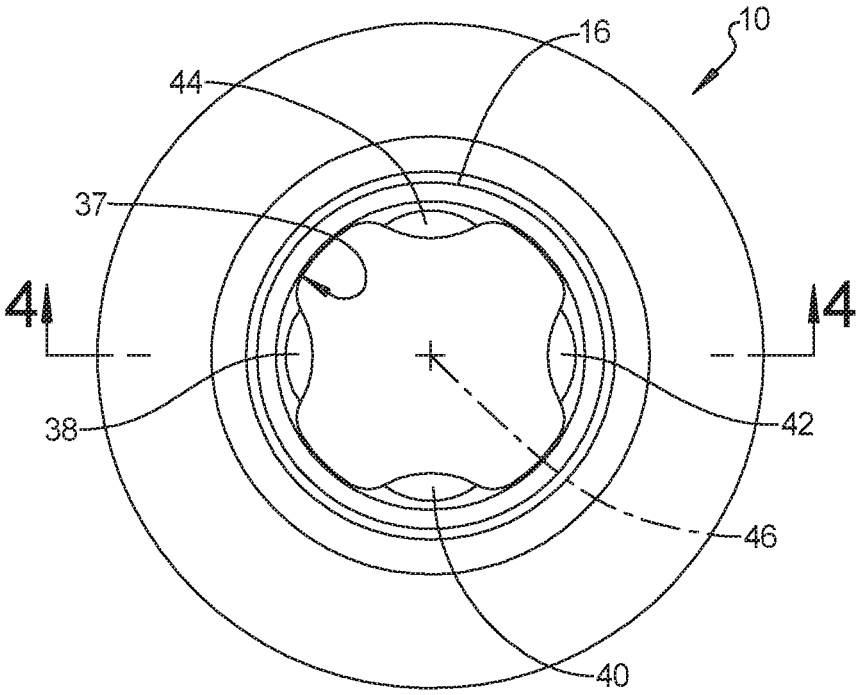
FIG. 2 is a top plan view of the lock knob bezel assembly of FIG. 1.

Referring to FIG. 3 and again to FIGS. 1 and 2, the umbrella 14 has a major diameter 47 at a bottom end of the umbrella 14 which defines a largest diameter of the body 12. A diameter 48 defined as an outermost extent of the fingers of opposed ones of the finger sets, for example an outermost extent of the fingers of the first finger set 18 and the third finger set 22 is less than the major diameter 47 of the umbrella 14. A slot or groove 49 can also be provided which extends between the umbrella 14 and the conical-shaped member 26 at each location of one of the dynamic interface members such as at the second dynamic interface member 40 shown. The groove 49 increases flexibility of the dynamic interface members.

Figure 3:
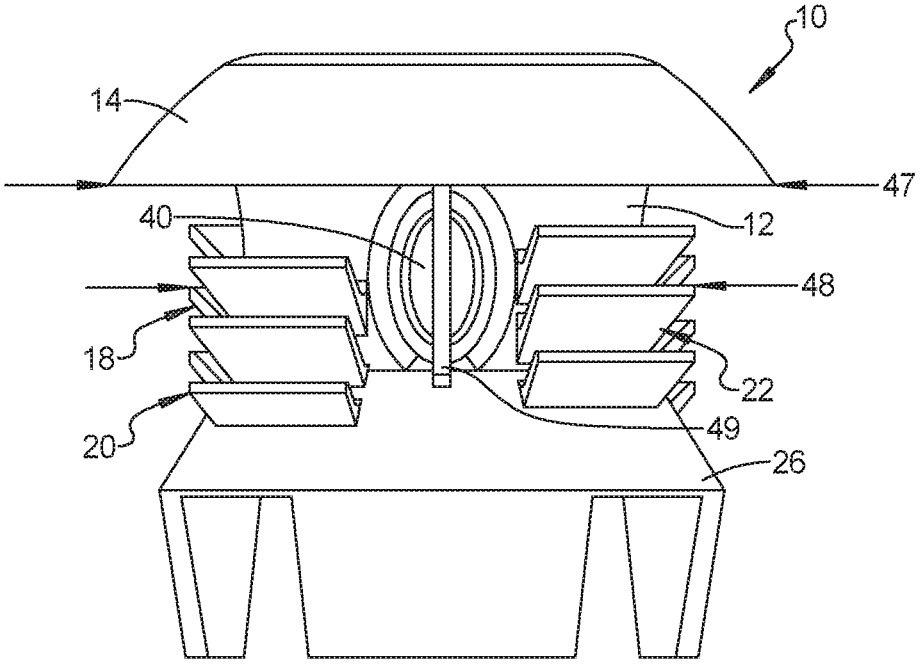
FIG. 3 is a front elevational view of the lock knob bezel assembly of FIG. 1.
Figure 4:
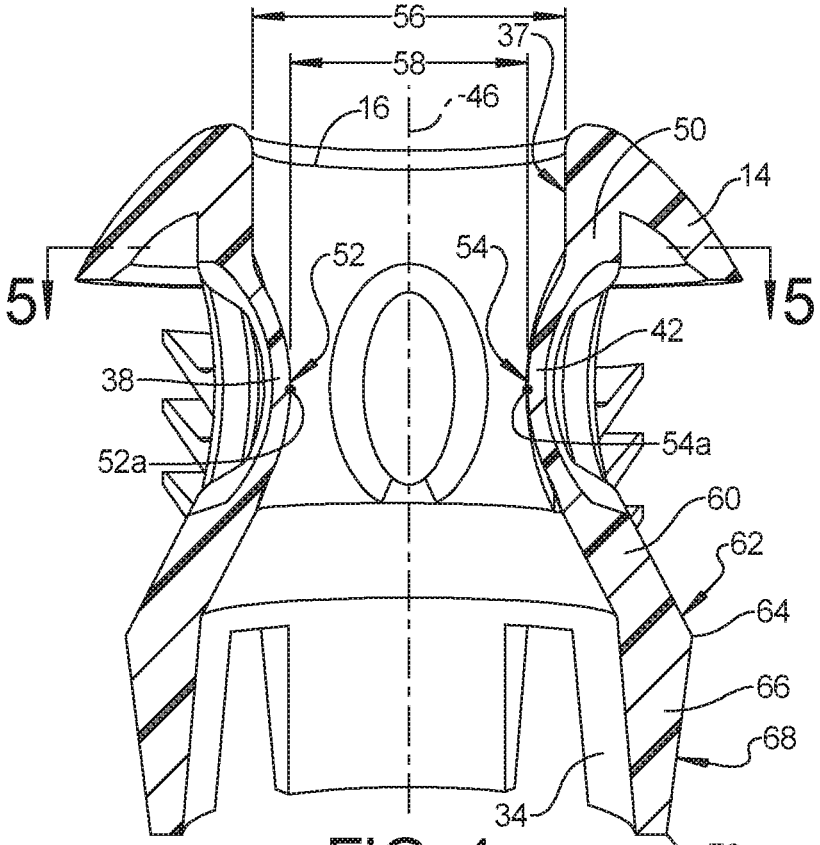
FIG. 4 is a cross sectional front elevational view taken at section 4 of FIG. 2.

Referring to FIG. 4 and again to FIGS. 1 through 3, the dynamic interface members are all positioned at a common elevation, are each directed inwardly into the cylindrical bore 16 and extend from the inner perimeter wall 37, and each defines a convex-shaped surface within the cylindrical bore 16. For example, the first dynamic interface member 38 provides a convex-shaped surface 52 which is directly opposed to a convex-shaped surface 54 of the third dynamic interface member 42. The cylindrical bore 16 through the umbrella 14 is defined by the inner perimeter wall 37 and has a first diameter 56. The closest points between any two opposed ones of the convex-shaped surfaces, or the closest points of all three dynamic interface members when only three dynamic interface members are provided, such as for example the closest points 52*a*, 54*a* between the opposed convex-shaped surface 52 and convex-shaped surface 54 define a second diameter 58, which is less than the first diameter 56 of the cylindrical bore 16 through the umbrella 14.

Each of the legs are similarly formed, therefore the following discussion of the third leg 34 applies to all of the legs. Third leg 34 includes an upper leg portion 60 having an outwardly sloping surface 62 extending away from the longitudinal central axis 46 of the body 12. The upper leg portion 60 extends to an outer inflection point 64 from which a lower leg portion 66 downwardly and inwardly extends toward the longitudinal central axis 46 of the body 12. The lower leg portion 66 includes an inwardly sloping surface 68. The lower leg portion 66 ends at an end point 70 which is positioned closer to the longitudinal central axis 46 of the body 12 than the inflection point 64.

Figure 5:
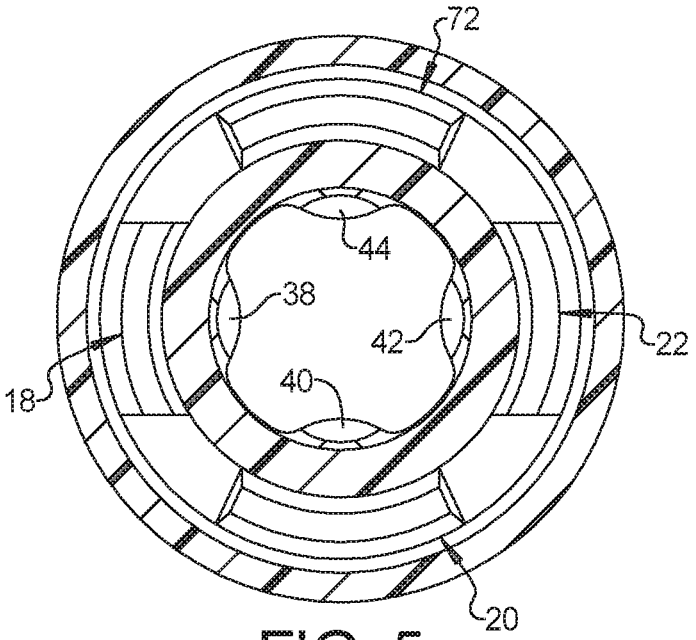
FIG. 5 is a cross sectional top plan view taken at section 5 of FIG. 4.

Referring to FIG. 5 and again to FIGS. 1 through 4, according to several aspects, the multiple sets of upwardly angled flexible fingers include four equidistantly spaced finger sets, including a first finger set 18, a second finger set 20, a third finger set 22 and a fourth finger set 72. Each of the finger sets is oriented at approximately 90-degree increments from a successive finger set. According to several aspects, each of the finger sets is positioned in direct alignment with one of the dynamic interface members although this is not dispositive. For example, the first finger set 18 is radially aligned with the first dynamic interface member 38, the second finger set 20 is radially aligned with the second dynamic interface member 40, the third finger set 22 is radially aligned with the third dynamic interface member 42 and the fourth finger set 72 is radially aligned with the fourth dynamic interface member 44.

Referring to FIG. 6 and again to FIGS. 1 through 5, the self-adjustable lock knob bezel 10 can be used in a lock knob assembly 74. The lock knob assembly 74 positions the umbrella 14 in 360-degree sealing contact with a substantially horizontal surface 76 of a vehicle door panel 78. The body 12 of the self-adjustable lock knob bezel 10 is pushed through an aperture 80 created in the vehicle door panel 78 and the fingers of each of the finger sets such as the first finger set 18 elastically deflect and seat in a deflected position against an inner wall 82 of the aperture 80. According to several aspects, the aperture 80 includes a chamfer to slidingly receive and elastically deflect the legs of the body 12 as described in greater detail below. The inner wall 82 is vertically downwardly extended by an extending portion 84 positioned below the surface 76 to increase a surface area for contact by each finger of the finger sets. According to several aspects, the extending portion 84 and the inner wall 82 define a conical-shape which narrows in diameter as the extending portion 84 extends away from the surface 76.

Installation of the self-adjustable lock knob bezel 10 into the aperture 80 is initiated by pushing the body 12 in a downward installation direction 86 until the end point 70 of each of the legs is received in the chamfer defined by the aperture 80. By further pushing the body 12, the legs each elastically deflect inwardly toward the longitudinal central axis 46 of the body 12 and then further elastically inwardly deflect as the legs slide along the conical shaped inner wall 82 of the aperture 80. After the inflection point 64 of the legs extends past an end surface 88 of the extending portion 84, the legs outwardly elastically rebound such that the outwardly sloping surface 62 contacts the end surface 88 thereafter resisting release of the body 12 in a release direction 90 opposite to the installation direction 86. A lock knob 92 is slidably received in the cylindrical bore 16 and an outer surface 94 of the lock knob 92 is frictionally contacted by each of the dynamic interface members such as the first dynamic interface member 38 and the third dynamic interface member 42 shown. The "football-shape" or curved surface geometry of each of the dynamic interface members maintains direct contact between the lock knob with the dynamic interface members at the substantially horizontal position of the umbrella 14 shown, and at any anticipated angular range of the umbrella 14 as discussed in reference to FIGS. 7 through 10 to maintain a vertical orientation of the lock knob 92.

Figure 6:
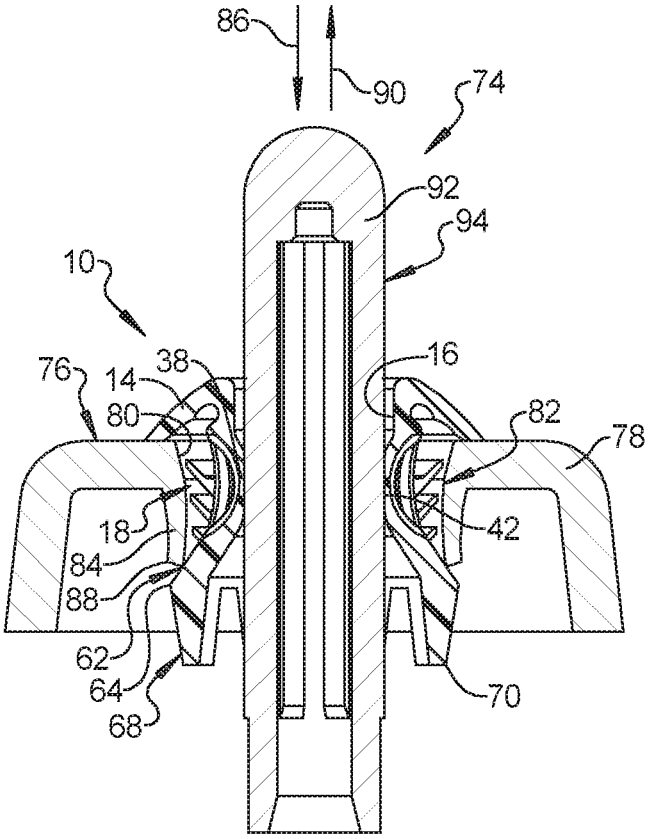
FIG. 6 is a cross sectional front elevational view of the lock knob bezel assembly of FIG. 4 further shown installed in a first vehicle door design.

Referring to FIG. 7 and again to FIG. 6, the self-adjustable lock knob bezel 10 can further be used in a lock knob assembly 97 modified from the lock knob assembly 74 by engagement of the umbrella 14 on a maximum pitched surface 96 of a vehicle door panel 98. A lock knob 100 is received through the self-adjustable lock knob bezel 10 similar to the lock knob 92.

Figure 7:
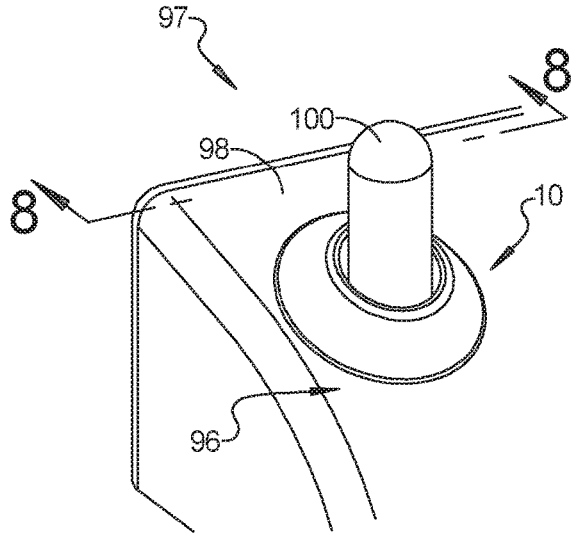
FIG. 7 is a front left perspective view of the lock knob bezel assembly of FIG. 1 further shown installed in a second vehicle door design.

Referring to FIG. 8 and again to FIG. 7, with the umbrella 14 sealingly engaged on the maximum pitched surface 96 of the vehicle door panel 98 a first elevation point 102 of the umbrella 14 is positioned at a higher elevation than a second elevation point 104. According to several aspects, the umbrella 14 is sufficiently flexible to maintain 360-degree contact with the maximum pitched surface 96 with the lock knob 100 maintained in a substantially vertically orientation when the maximum pitched surface 96 defines an angle alpha ($\alpha$) of up to approximately 25 degrees from a horizontal reference 106. According to several aspects the maximum pitched surface 96 is substantially planar but can have a small curvature of up to approximately ten (10) degrees variation. According to several aspects direct contact between the lock knob 100 and the dynamic interface members is maintained if the maximum pitched surface 96 varies up to approximately twenty-five (25) degrees of variation, and if the maximum pitched surface 96 includes one or more curved portions.

Figure 8:
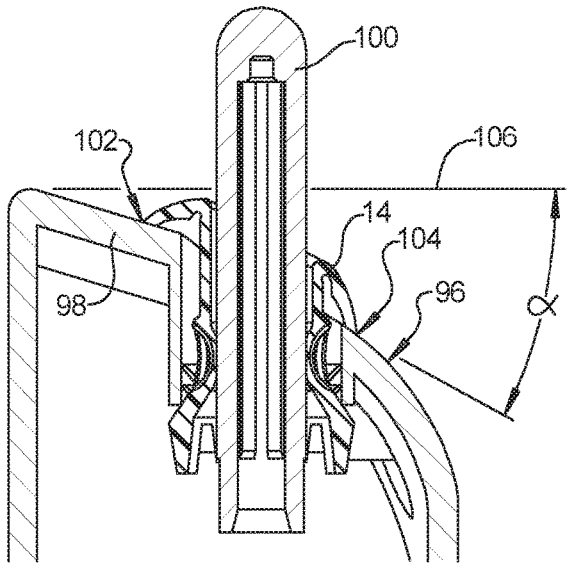
FIG. 8 is a cross sectional front elevational view taken at section 8 of FIG. 7.

Referring to FIG. 9 and again to FIGS. 6 through 8, the self-adjustable lock knob bezel 10 can further be used in a lock knob assembly 107 modified from the lock knob assembly 74 by engagement of the umbrella 14 on a curved or variable pitched surface 108 of a vehicle door panel 110. A lock knob 112 is received through the self-adjustable lock knob bezel 10 similar to the lock knob 92.

Referring to FIG. 10 and again to FIGS. 6 through 9, with the umbrella 14 sealingly engaged on the variable pitched surface 108 of the vehicle door panel 110 a first elevation point 114 of the umbrella 14 is positioned at a higher elevation than a second elevation point 116. According to several aspects, the umbrella 14 is sufficiently flexible to maintain 360 degree contact with the variable pitched surface 108 with the lock knob 112 maintained in a substantially vertically orientation when the variable pitched surface 108 defines an angle beta (β) which can continuously vary between the first elevation point 114 and the second elevation point 116 up to approximately 25 degrees of variation from a horizontal reference 118. According to several aspects direct contact between the lock knob 112 and the dynamic interface members is maintained if the variable pitched surface 108 is substantially continuously curved up to approximately twenty-five (25) degrees of variation, and if the variable pitched surface 108 includes one or more short planar segments.

Referring to FIG. 11 and again to FIG. 6, the lock knob assembly 74 is depicted in a locked position, but any lock knob assembly of the present disclosure is adapted to allow the lock knob, such as the lock knob 92 to be maintained in a substantially vertical orientation at the lowered or locked position, or vary away from the vertical orientation, due to continuous frictional contact maintained between the lock knob and all of the dynamic interface members such as the first dynamic interface member 38 and the third dynamic interface member 42 shown. In the lowered or locked position, an upper portion 120 of the lock knob 92 is positioned at or above the umbrella 14, however substantially all of a lower portion 122 of the lock knob 92 is positioned below the dynamic interface members.

Figure 11:
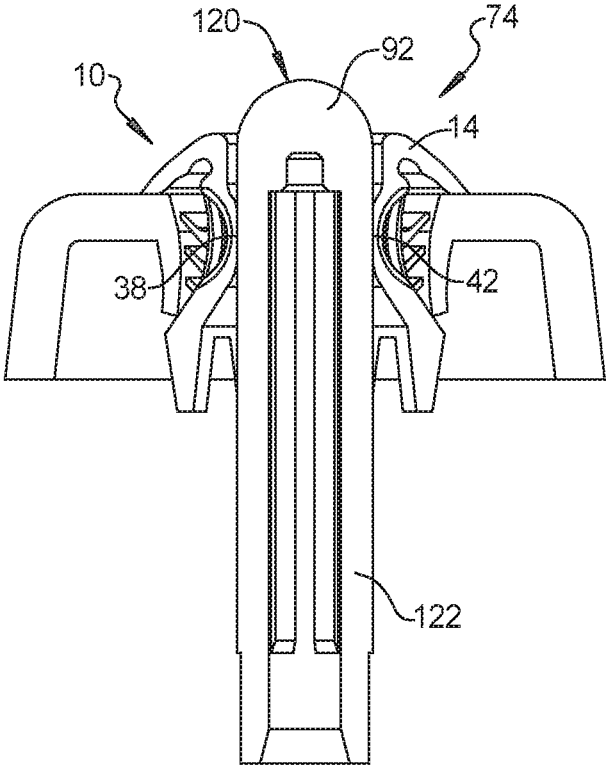
FIG. 11 is a cross sectional front elevational view of the lock knob bezel assembly of FIG. 4 further shown with a lock knob in a locked, down position.
Figure 12:
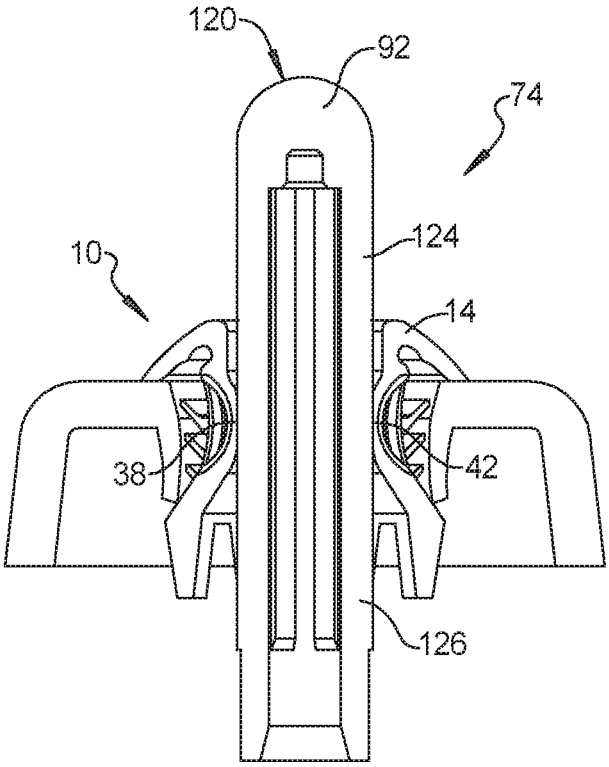
FIG. 12 is a cross sectional front elevational view of the lock knob bezel assembly of FIG. 4 further shown with a lock knob in an un-locked, up position.

Referring to FIG. 12 and again to FIG. 11, the lock knob assembly 74 is depicted in a un-locked position, but any lock knob assembly of the present disclosure is adapted to allow the lock knob, such as the lock knob 92 to be maintained in a substantially vertical orientation at the raised or un-locked position, or vary away from the vertical orientation, due to continuous frictional contact maintained between the lock knob and all of the dynamic interface members such as the first dynamic interface member 38 and the third dynamic interface member 42 shown. In the raised or un-locked position, the upper portion 120 of the lock knob 92 and approximately an upper half portion 124 are positioned at or above the umbrella 14, and a lower half portion 126 of the lock knob 92 is positioned below the dynamic interface members.

Figure 13:
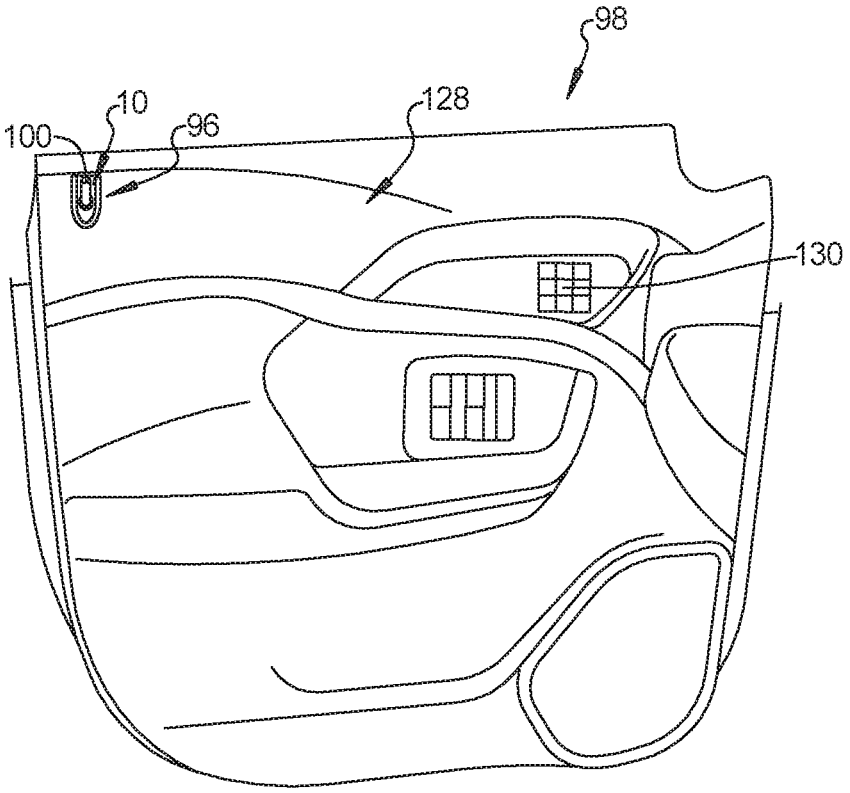
FIG. 13 is a side elevational view of a first vehicle door panel having a lock knob bezel assembly of the present disclosure.

Referring to FIG. 13 and again to FIGS. 7 and 8, the vehicle door panel 98 is presented after installation of the self-adjustable lock knob bezel 10 and the lock knob 100 defining the lock knob assembly 97. An inner door fascia 128 of the vehicle door panel 98 provides access to a remote locking device 130 used to remotely actuate the lock knob 100.

Figure 9:
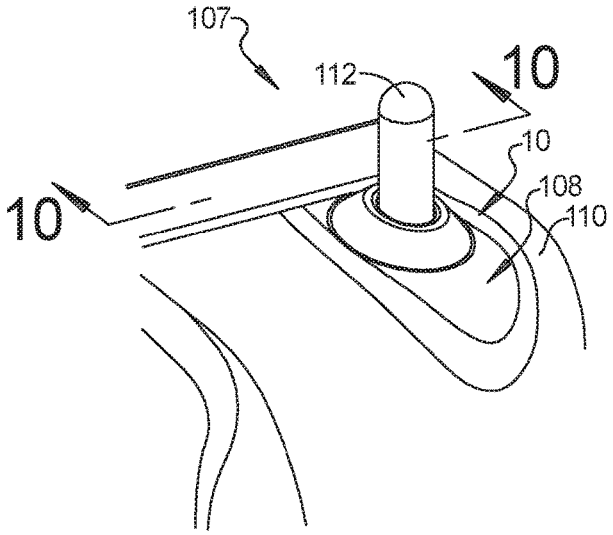
FIG. 9 is a front left perspective view of the lock knob bezel assembly of FIG. 1 further shown installed in a third vehicle door design.
Figure 10:
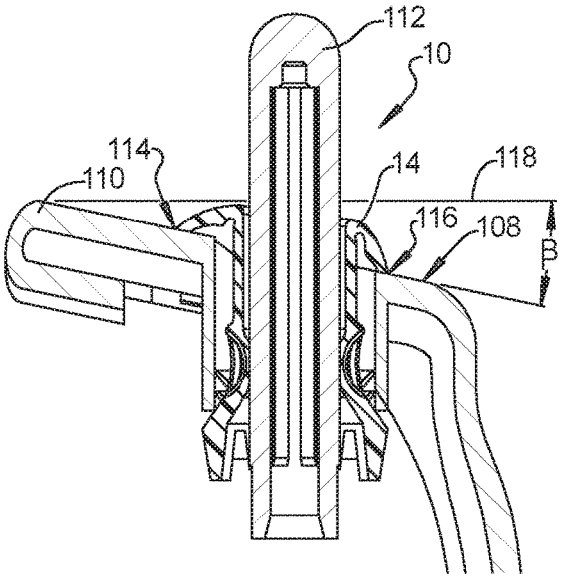
FIG. 10 is a cross sectional front elevational view taken at section 10 of FIG. 9.
Figure 14:
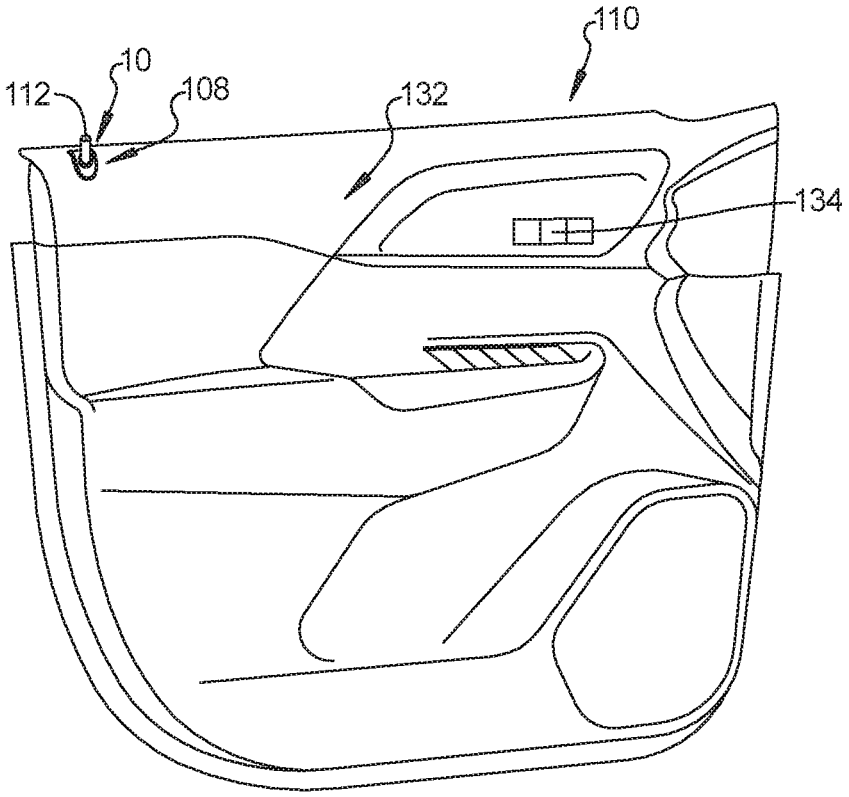
FIG. 14 is a side elevational view of a second vehicle door panel having a lock knob bezel assembly of the present disclosure.

Referring to FIG. 14 and again to FIGS. 9 and 10, the vehicle door panel 110 is presented after installation of the self-adjustable lock knob bezel 10 and the lock knob 112 defining the lock knob assembly 107. An inner door fascia 132 of the vehicle door panel 110 also provides access to a remote locking device 134 used to remotely actuate the lock knob 112.

A self-adjustable lock knob bezel and a self-adjustable lock knob bezel assembly of the present disclosure offer several advantages. These include reduction/elimination of part number complexity by adding a flexible bezel surface, an umbrella cap feature which follows the upper surface orientation of multiple different door panel designs, providing an increased angular installation range from zero up to approximately 25 degrees. The same bezel can be used on all four vehicle doors and on multiple vehicle designs. Installation poke-yoke that is currently required for bezel designs to prevent incorrect installation is no longer required. Multiple flexible fingers are provided together with multiple dynamic interface members which are designed to interfere with a lock knob to avoid rattle noise. The dynamic interface members are flexible to maintain contact with the lock knob at any lock knob vertical position, manage interface variation, and reduce rod friction and binding.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A self-adjustable lock knob bezel, comprising:

a body of a polymeric material, the body including:

an elastically flexible umbrella having a cylindrical bore extending through the umbrella;

multiple dynamic interface members positioned within the cylindrical bore and extending away from an inner perimeter wall defined by the cylindrical bore toward a longitudinal central axis of the body, wherein each of the dynamic interface members includes a convex shaped curved surface facing toward the longitudinal central axis of the body;

multiple flexible finger sets extending outwardly from the body; and multiple elastically deflecting legs positioned below the finger sets.

2. The self-adjustable lock knob bezel of claim 1, wherein a closest point of each of opposed ones of the curved surfaces of the dynamic interface members defines a diameter smaller than a diameter of the cylindrical bore.

3. The self-adjustable lock knob bezel of claim 1, wherein each of the flexible finger sets is radially aligned with one of the dynamic interface members.

4. The self-adjustable lock knob bezel of claim 1, wherein each of the flexible finger sets includes multiple upwardly directed elastically flexible fingers.

5. The self-adjustable lock knob bezel of claim 1, wherein a diameter defined by opposed ones of the flexible finger sets is less than a diameter of the umbrella.

6. The self-adjustable lock knob bezel of claim 1, wherein each of the legs includes an upper leg portion having an outwardly sloping surface extending away from the longitudinal central axis of the body.

7. The self-adjustable lock knob bezel of claim 6, wherein the upper leg portion of each of the legs extends to an outer inflection point from which a lower leg portion downwardly and inwardly extends toward the longitudinal central axis of the body.

8. The self-adjustable lock knob bezel of claim 7, wherein the lower leg portion ends at an end point which is positioned closer to the longitudinal central axis of the body than the inflection point.

9. The self-adjustable lock knob bezel of claim 1, wherein the multiple dynamic interface members include a first dynamic interface member, a second dynamic interface member, a third dynamic interface member and a fourth dynamic interface member, each having a football-shape, and each equidistantly separated from a successive one of the dynamic interface members.

10. A self-adjustable lock knob bezel assembly, comprising:

a body of a polymeric material, the body including:

an elastically flexible umbrella having a cylindrical bore extending through the umbrella;

multiple dynamic interface members positioned within the cylindrical bore and extending away from an inner perimeter wall defined by the cylindrical bore toward a longitudinal central axis of the body;

multiple flexible finger sets extending outwardly from the body; and multiple elastically deflecting legs positioned below the finger sets;

a vehicle door panel having an aperture receiving the body; and a lock knob positioned within the cylindrical bore and directly contacting each of the dynamic interface members in each of a raised un-locked position and a lowered locked position, wherein each of the flexible finger sets includes multiple upwardly directed elastically flexible fingers each directly contacting an inner wall defined by the aperture to resist release of the body from the aperture and the inner wall is downwardly extended by an extending portion positioned below a surface of the vehicle door panel to increase a surface area for contact by each of the flexible fingers.

11. The self-adjustable lock knob bezel assembly of claim 10, further including an inflection point of each of the legs extending past an end surface of the extending portion in an installed position of the body, with the legs outwardly elastically rebounding such that an outwardly sloping surface of each of the legs contacts the end surface to resist release of the body from the aperture.

12. The self-adjustable lock knob bezel assembly of claim 10, wherein when the umbrella is positioned against a maximum pitched surface of the vehicle door panel defining an angle alpha of up to approximately 25 degrees from a horizontal reference the umbrella sealingly engages for 360 degrees against the vehicle door panel and a first elevation point of the umbrella is positioned at a higher elevation than a second elevation point of the umbrella with the lock knob maintained in a substantially vertical orientation in each of the raised un-locked position and the lowered locked position.

13. The self-adjustable lock knob bezel assembly of claim 10, wherein when the umbrella is positioned against a variable pitched surface of the vehicle door panel that is substantially continuously curved ranging over an angle beta of up to approximately 25 degrees from a horizontal reference, the umbrella sealingly engages for 360 degrees against the vehicle door panel and a first elevation point of the umbrella is positioned at a higher elevation than a second elevation point of the umbrella with the lock knob maintained in a substantially vertical orientation in each of the raised un-locked position and the lowered locked position.

14. The self-adjustable lock knob bezel assembly of claim 10, wherein the aperture includes a chamfer to slidingly receive and elastically deflect the legs of the body.

15. A method for aligning a lock knob using a self-adjustable lock knob bezel assembly, comprising:

aligning multiple legs of a self-adjustable lock knob bezel with an aperture created in a vehicle door panel and inserting the lock knob bezel into the aperture to elastically inwardly deflect the legs;

continuing to insert the lock knob bezel into the aperture until multiple flexible finger sets extending outwardly from a lock knob bezel body elastically deflect and directly contact in inner wall defined by the aperture;

completing insertion of the lock knob bezel by seating an elastically flexible umbrella of the lock knob bezel against a surface of the vehicle door panel and inserting the lock knob bezel until an inflection point of each of the legs extends past an end surface of an extending portion of the aperture thereafter allowing the legs to outwardly deflect to contact the end surface; and positioning a lock knob within a cylindrical bore of the umbrella with the lock knob directly contacting each of multiple dynamic interface members extending into the cylindrical bore from an inner perimeter wall defined by the cylindrical bore.

16. The method for aligning a lock knob using a self-adjustable lock knob bezel assembly of claim 15, wherein the completing insertion of the lock knob bezel step further includes positioning the umbrella such that the umbrella is sealingly engaged for 360 degrees against the surface of the vehicle door panel and a first elevation point of the umbrella is positioned at a higher elevation than a second elevation point of the umbrella with the lock knob maintained in a substantially vertical orientation in each of a raised un-locked position and a lowered locked position.

* * * * *